US010260007B2

(12) United States Patent
Barroeta et al.

(10) Patent No.: US 10,260,007 B2
(45) Date of Patent: Apr. 16, 2019

(54) DESALTER OPERATION

(71) Applicants: Magaly C. Barroeta, Tomball, TX (US); Gregory Mason Goodman, Baton Rouge, LA (US); Ashok Uppal, Sarnia (CA); Mohsen Shahmirzadi Yeganeh, Hillsborough, NJ (US); Jose X. Simonetty, Kingwood, TX (US)

(72) Inventors: Magaly C. Barroeta, Tomball, TX (US); Gregory Mason Goodman, Baton Rouge, LA (US); Ashok Uppal, Sarnia (CA); Mohsen Shahmirzadi Yeganeh, Hillsborough, NJ (US); Jose X. Simonetty, Kingwood, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 278 days.

(21) Appl. No.: 14/994,623

(22) Filed: Jan. 13, 2016

(65) Prior Publication Data

US 2016/0208176 A1 Jul. 21, 2016

Related U.S. Application Data

(60) Provisional application No. 62/104,234, filed on Jan. 16, 2015.

(51) Int. Cl.

| | |
|---|---|
| ***C10G 31/08*** | (2006.01) |
| ***C10G 33/02*** | (2006.01) |
| ***C10G 33/04*** | (2006.01) |
| ***C10G 53/02*** | (2006.01) |

(52) U.S. Cl.
CPC ..... *C10G 31/08* (2013.01); *C10G 33/02* (2013.01); *C10G 33/04* (2013.01); *C10G 53/02* (2013.01)

(58) Field of Classification Search
CPC ..... C10G 33/02; C10G 33/04
See application file for complete search history.

(56) References Cited

U.S. PATENT DOCUMENTS

| | | | | |
|---|---|---|---|---|
| 4,722,781 | A * | 2/1988 | Swartz | C10G 31/08 208/177 |
| 4,737,265 | A * | 4/1988 | Merchant, Jr. | C10G 33/04 166/267 |
| 5,746,908 | A | 5/1998 | Mitchell | |
| 7,867,382 | B2 | 1/2011 | Droughton | |
| 7,923,418 | B2 | 4/2011 | Becker | |
| 7,981,979 | B2 | 7/2011 | Flatt | |
| 2015/0175904 | A1* | 6/2015 | Yeganeh | C10G 32/02 204/567 |
| 2015/0267127 | A1* | 9/2015 | Yeganeh | C10G 31/08 204/567 |

* cited by examiner

*Primary Examiner* — Bryan D. Ripa
(74) *Attorney, Agent, or Firm* — Glenn T. Barrett

(57) ABSTRACT

Improved separation of oil and water as well as suspended solids from the emulsion layer formed in a petroleum desalter is achieved by injection of demulsifier into the desalter vessel to achieve a higher localized concentration of demulsifier in the emulsion layer so as to promote improved oil/water separation from the emulsion layer. The demulsifier may be injected into the water layer or the oil layer in the region of the emulsion layer or directly into the stabilized emulsion layer.

3 Claims, 3 Drawing Sheets

DESALTER OPERATION

CROSS-REFERENCE TO RELATED APPLICATIONS

This application claims priority to U.S. Provisional Application Ser. No. 62/104,234 filed Jan. 16, 2015, herein incorporated by reference in its entirety.

FIELD OF THE INVENTION

This invention relates to crude petroleum desalting and to the desalter unit.

BACKGROUND OF THE INVENTION

Crude petroleum normally contains mineral salts that may corrode refinery units; the salt is removed from the crude oil by a process known as "desalting", in which hot crude oil is mixed with water and a suitable demulsifying agent to form a water-in-oil emulsion which provides intimate contact between the oil and water, transferring salt into the water. The salty emulsion is then passed into a high voltage electric field inside a closed separator vessel. The electric field forces water droplets to coalesce, forming larger water droplets. As the water droplet volumes increase, they settle to the bottom of the tank under gravitation. The desalted oil forms at the upper layer in the desalter from where it is continuously drawn off for distillation. The salty water is withdrawn from the bottom of the desalter.

During operation of desalter units, a stable emulsion phase (also known as a "rag layer") of variable composition and thickness forms above the interface between the oil and the separated bulk water phase at the bottom of the desalter. This interface will be referred to here as "oil/bulk-resolved water interface". The formation of a rag layer is mostly due to stability of the oil/bulk-resolved-water interface caused by natural surfactants (e.g. asphaltenes, naphthenic acid) and/or solids. Solids, particularly, can reside at the interface generating a physical barrier against the immersion of water droplets into the bulk water phase at the bottom of the desalter. The formation of the rag layer is especially problematic for crude with high amounts of natural surfactants and/or solids. The growth of the rag layer reduces workable volume and may cause shorting within the electric circuit and force unplanned and costly desalter shut down. Additionally, processing crudes with high rag layer formation tendencies in current desalter configurations may cause poor desalting (salt removal) efficiency as a result of the accumulation of solids at the bottom of the vessel, and/or a solids-stabilized rag layer leading to erratic level control and insufficient residence time for proper water/oil separation. Formation of the rag layers has become a major desalter operating concern, generating desalter upsets, increased preheat train fouling, and deteriorating quality of the brine effluent and disruption of the operation of the downstream wastewater treatment facilities.

The water content of the rag layer may range from 20 to 95% water with the balance being hydrocarbon (normally full range crude oil) and up to 5 weight percent inorganic solids. Precipitated asphaltenes, waxes, and paraffins may also be found at elevated levels in the rag layer (compared to the incoming crude oil) which combine with particulates (solids), to bind the mixture together to form a complex structure that is highly stable. Intractable emulsions of this kind comprising of oil, water and solids make adequate separation and oil recovery difficult. Often, these stable emulsions arising from the desalter are periodically discarded as slop streams. This results in expensive treating or handling procedures or pollution problems as well as the fact that crude oil is also lost with these emulsions and slop streams.

Refinery sites which process high solids-content crudes have the most pervasive problems with emulsion formation. Heavy crude oils and bitumens from Western Canada, which contain elevated levels of small clay fines and other small solids, are particularly prone to forming large volumes of highly stable emulsions. With such feeds, growth of the rag layer is more prevalent. These feeds are, however, being introduced to refineries in greater quantities despite two main disadvantages related to the efficacy of desalting. First, the viscosity of these crudes can be quite high, so transport of water through the feed is slower than in high API gravity crude. Second, the density mismatch between water and oil is lower, so the gravitational energy gradient is reduced compared to higher API gravity crudes. Growth of the rag layer in the desalter requires either the amount of crude passed through the desalter to be reduced or removal of the rag layer from the desalting vessel for external treatment.

Attempts to mitigate the effects of rag layer formation are normally carried out by withdrawal of the emulsion from the unit or by the addition of chemical demulsifiers upstream of a desalter. The use of demulsifiers has proven to be effective in reducing emulsion stability between electrodes in a desalter, but may not be effective in reducing the rag layer build-up which is mainly due to stability of the oil/bulk-resolved-water interface. The common practice for application of demulsifiers has been to add the chemical demulsifiers to the water, oil, or the emulsion before introducing the oil/water mixture to the electric field, as shown by the following references:

U.S. Pat. No. 5,746,908 (Mitchell/Phillips Petroleum), discloses the use of steam to form an emulsion and then adding demulsifier to the mixture.

U.S. Pat. No. 7,867,382 (Droughton) discloses the use of demulsifier and mesoporous materials for reducing water-in-oil emulsion stability.

U.S. Pat. No. 7,923,418 (Becker/Baker Hughes) discloses the use of acrylate polymer emulsion breakers for reducing stability of a water-in-oil emulsion.

U.S. Pat. No. 7,981,979 (Flatt/Nalco) discloses the use of siloxane cross-linked demulsifiers for reducing water-in-oil emulsion stability.

A shortcoming of the current practice is due, in part, to the inability of chemical demulsifiers to reach high enough concentrations at the oil/bulk-resolved-water interface, particularly at the beginning of the desalter operation. Accordingly, the need persists for more effective techniques for mitigating the effects of rag layer formation.

SUMMARY OF THE INVENTION

We have now found that injection of the demulsifier into the desalter vessel can result in higher concentrations of the demulsifier in the emulsion layer which forms above the interface between the denser water layer and the supernatant oil layer. By achieving this higher, localized concentration of demulsifier in the region where it is needed, namely, in the emulsion layer itself, a consequent improvement in separation of the oil and water phases from the emulsion layer is achieved.

The demulsifier may be injected directly into the emulsion layer or onto it with injectors located either in the water layer or the oil layer, facing in the appropriate direction, i.e.

upwards from the water layer and downwards from the oil layer. When the demulsifier is injected from either the oil or water layers, it is preferably injected in the region of the emulsion layer in order to secure the desired higher concentration of demulsifier in the emulsion layer. Provision may be made in the desalter vessel for locating the injection points at multiple locations in the vessel, spaced either vertically or horizontally from each other or both vertically and horizontally. In this way, the thickness of the rag layer may be controlled more readily within predetermined limits so that operation of the desalter is materially improved.

The desalting process entails mixing a crude oil with water and exposing a mixture of oil and water in the form of an emulsified oil/water mixture to an electric field to cause separation of the mixture into a denser water layer containing dissolved salts and a supernatant oil layer with the formation of a stabilized emulsion layer between the oil layer and the separated water layer, typically being located above the interface between the denser water layer and the supernatant oil layer. This layer often contains emulsion-stabilizing solids which normally inhibit separation of the oil and water into separate phases. According to the present invention, demulsifier is added to the water layer or the oil layer or directly into the stabilized emulsion layer to destabilize the emulsion so as to promote separation of the oil and water which can then be removed as separate phases. Optionally, demulsifier may also be added to the oil/water mixture upstream of the desalter.

A petroleum desalter unit according to the invention comprises a desalter vessel having an inlet for an oil/water mixture and electrical grids within the vessel for imposing an electric field on the oil/water mixture in the vessel to cause separation of the mixture into a denser water layer containing dissolved salts and a supernatant oil layer with the formation of a stabilized emulsion layer between the oil layer and the separated water layer; a water outlet for removing water and an oil outlet for removing oil are also provided. Demulsifier injectors are located for injecting demulsifier into the vessel at in the region of the emulsion layer.

DRAWINGS

DETAILED DESCRIPTION

Figure 1:
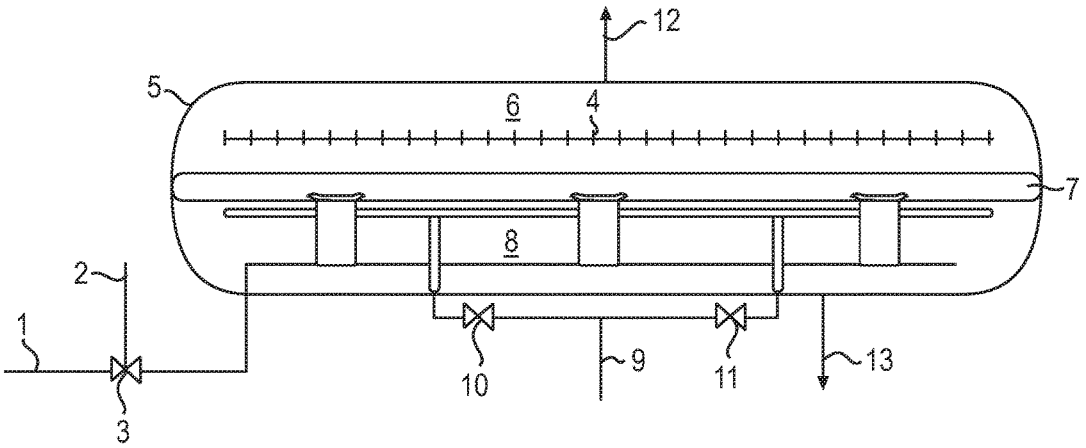
FIG. 1 shows a much simplified schematic of a crude petroleum desalter unit utilizing the option of direct injection of the demulsifier into the emulsion layer or into the water layer.

Desalting is one of the first steps in crude refining. It is done to remove salts and particulates to reduce corrosion, fouling and catalyst poisoning. In a typical desalting process, fresh water (also referred to as wash water) is mixed with oil to produce a water-in-oil emulsion, which in turn extracts salt, brine and some particulates from the oil. The salty emulsion is then sent to a desalter unit where the application of an electric field forces water droplets to coalesce. Large electrocoalesced water droplets settle under gravity and penetrate through the oil/bulk-resolved-water interface to immerse into the resolved bulk water phase at the bottom of the desalter. The desalted oil and the resolved bulk water are then removed at the top and the bottom of a desalter, respectively.

The wash water used to treat the crude oil may be derived from various sources and the water itself may be, for example, recycled refinery water, recirculated wastewater, clarified water, purified wastewater, sour water stripper bottoms, overhead condensate, boiler feed water, clarified river water or from other water sources or combinations of water sources. Salts in water are measured in parts per thousand by weight (ppt) and typically range from fresh water (<0.5 ppt), brackish water (0.5-30 ppt), saline water (30-50 ppt) to brine (over 50 ppt). Although deionized water may be used to favor exchange of salt from the crude into the aqueous solution, de-ionized water is not normally required to desalt crude oil feedstocks although it may be mixed with recirculated water from the desalter to achieve a specific ionic content in either the water before emulsification or to achieve a specific ionic strength in the final emulsified product. Wash water rates may be between approximately 5% and approximately 7% by volume of the total crude charge, but may be higher or lower dependent upon the crude oil source and quality. Frequently, a variety of water sources are mixed as determined by cost requirements, supply, salt content of the water, salt content of the crude, and other factors specific to the desalting conditions such as the size of the separator and the degree of desalting required.

Conventional types of demulsifier commonly used in the processing of crude oil are useful in the present process although the process is not reliant on the particular selection of demulsifier. Among the demulsifiers which may be used are those typically based on the following chemistries: polyethyleneimines, polyamines, polyols, ethoxylated alcohol sulfates, long chain alcohol ethoxylates, long chain alkyl sulfate salts, e.g. sodium salts of lauryl sulfates, epoxies, di-epoxides (which may be ethoxylated and/or propoxylated). A useful class of polyamines comprises the succinated polyamines prepared by the succination of polyamines/polyamine/imines with a long chain alkyl substituted maleic anhydride.

Challenged crudes (i.e. crude with a high amount of particulates and/or natural emulsifiers) have been shown to produce a substantial amount of stable emulsion layers (a.k.a. rag layer), accumulating above the interface between the oil and resolved bulk water. The existence of a rag layer is mostly due to the inability of electrocoalesced droplets to break the oil/bulk-resolved-water interface. The rag layer in the desalter typically contains a high concentration of oil, residual water, suspended solids and salts which, in a typical example, might be approximately 70% v/v water, 30% v/v oil, with 5000-8000 pounds per thousand barrels (PTB) (about 14 to 23 g/l.) solids, and 200-400 PTB (about 570 to 1100 mg/l.) salts. The aqueous phase contains salts from the crude oil. Crudes with high solids contents present a particularly intractable problem since the presence of the solids, often with particle sizes under 5 microns, may act to stabilize the emulsion and the oil/bulk-resolved-water interface, leading to a progressive increase in the depth of the rag layer.

The present invention is especially useful in its application to challenged crudes containing high levels of solids and it may also be applied to benefit the desalting of high asphaltene content crudes which also tend to stabilize the emulsion layer and the oil/bulk-resolved-water interface in a desalter. The conventional mitigation strategies carried out by enhancing the electrocoalescence in the desalter by, for example, the upstream addition of chemical demulsifiers tend to be less than totally effective in reducing the stability of the oil/bulk-resolved-water interface. This is likely due to the inability of the additive to fully reach the oil/bulk-resolved-water interface at the beginning of the desalting operation. Thinning of the oil film between electrocoalesced water droplets and the resolved bulk water phase is mainly due to the gravitational force. A slow rate of film thinning reduces the ability of electrocoalesced water droplets to immerse into the resolved bulk water phase, causing the growth of a rag layer. The rate of film thinning strongly depends on the particulates and the chemistry of the oil at that interface and it may depend on physical parameters different from those of the electrocoalescence mechanism. The mechanism of emulsion stability within the electrodes, therefore, may not be the same as that of the stability of the oil/bulk-resolved-water interface. This in turn demands the different additive treatment for the oil/bulk-resolved-water interface which is provided in the present desalting process.

To accommodate growth and movement of the emulsion layer in the vessel, the emulsifier inlet line may be provided with a manifold with inlet ports at different vertically spaced levels permitting the emulsifier to be injected into the emulsion at one or more of the ports as required. The ports may be provided with manually or, more preferably, automatic, operated valves to control the injection of the demulsifier. Addition of demulsifier into the resolved bulk water phase and/or rag layer can also be combined with addition of other demulsifiers upstream of the desalter.

FIG. 1 shows a vertical cross-section of a desalter vessel in in which injection of the demulsifier takes place at rag layer level and optionally into the water layer using a straight pipe design as a header system. The incoming crude oil feed to be desalted enters by way of line 1 and is mixed with fresh wash water feed from line 2 in mixing valve 3 to emulsify the water into the oil before the mixture is introduced into the desalter vessel (5). Under the high voltage electric field induced by means of electrode grids (4), the separation of the oil phase (6) and the water phase (8) takes place with the emulsion phase (rag layer) (7) forming at the interface between the oil and water phases. Demulsifier is injected directly into the emulsion layer or the water phase by way of line (9) with discharge outlets located along the length of the line to promote the desired distribution into the emulsion or into the water layer in the region of the emulsion layer. When injected into the water layer, the injection is preferably effected not more than 20 cm from the lower level of the emulsion layer and even more preferably within 10 cm of the lower edge of the emulsion layer in order to promote the high demulsifier concentration in or at the emulsion layer. The feed rate to the injector line is controlled by means of valves (10) and (11). Desalted oil is withdrawn from an outlet in the upper portion of the vessel and passes to refinery processing in line 12; salty water (brine) containing salts washed out of the crude is withdrawn from an outlet at the bottom of the vessel through line 13 and sent to waste water recovery.

With this improved control of the emulsion layer position and thickness, the injection line (9) may be positioned at a suitable fixed level in the vessel but if different crude feeds generating emulsion layers of different thicknesses are liable to be encountered, a plurality of separately valved injection lines may be located within the vessel with control of demulsifier to the line at the appropriate level for optimal demulsification.

Figure 2:
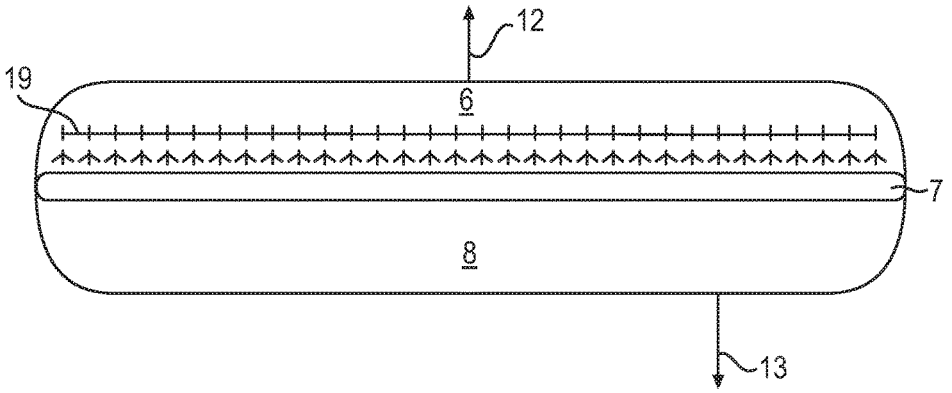
FIG. 2 shows a much simplified schematic of a crude petroleum desalter unit utilizing the option of injection from the oil layer downwards into the emulsion layer.

FIG. 2 shows a vertical cross-section of a desalter vessel in which injection of demulsifier takes place into the rag layer using a downward facing header in the oil phase. A header system (19) is positioned above the rag layer (7), with nozzles or slots facing downwards to deliver demulsifier chemical above the interface from the emulsion/oil phase (6).

Figure 3:
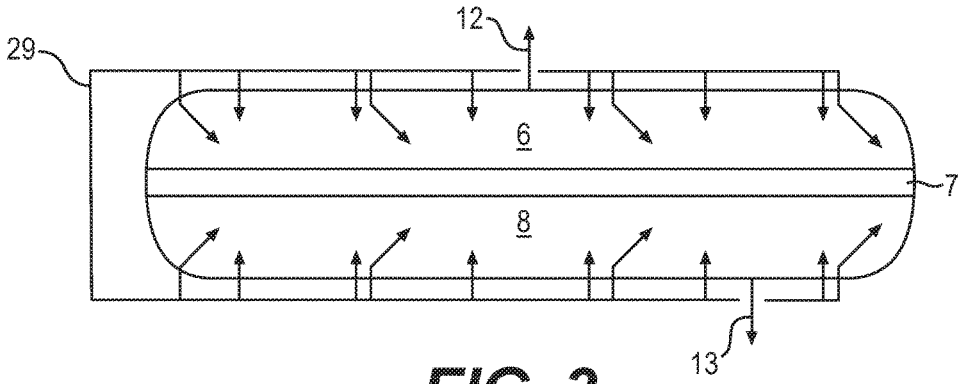
FIG. 3 shows a much simplified schematic of a crude petroleum desalter unit utilizing the option of injection from the oil layer at varying angles towards the emulsion layer.

FIG. 3 shows a horizontal cross-section of a desalter vessel in which injection of demulsifier into desalter using injection quills varying location, angle, and velocity. Injection quills (29) positioned around the perimeter of the desalting vessel can be used to deliver demulsifier chemical into the rag layer (7) or onto it from above or below from a variety of angles with varying velocities and flowrates controlled by suitable valving and control devices. Depending upon the locations of the mixture inlet and the oil and water outlets, and the general flow direction of the oil, water and emulsion layers in the vessel, the injectors may be angled concurrent with relative to the general flow axis so as to promote flow or to promote mixing by countercurrent injection.

Combinations of injector configurations may be used, for example, injection into both the water and oil layers by use of an injection line below the emulsion layer and above it in the oil layer.

Figure 4:
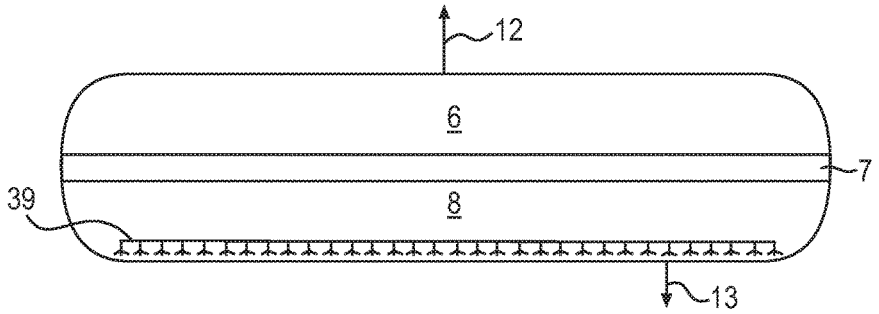
FIG. 4 shows a much simplified schematic of a crude petroleum desalter unit utilizing the option of injection downwards into the water layer using an existing mudwash system.

FIG. 4 shows a vertical cross-section of a desalter vessel in which injection of demulsifier into desalter is effected using the current mudwash system. The mudwash system (39) which is important for the removal of solids that accumulate on the bottom of the desalting vessel. A header, located approximately 18 inches (46 cm) from the bottom of the vessel and running the length of the desalter, has a number of downward facing water spray nozzles designed to disturb solids and prevent accumulation on the vessel bottom. This system can be used to deliver the demulsifier chemical to the water phase (8) within the desalting vessel with limited modification to the existing unit.

Figure 5:
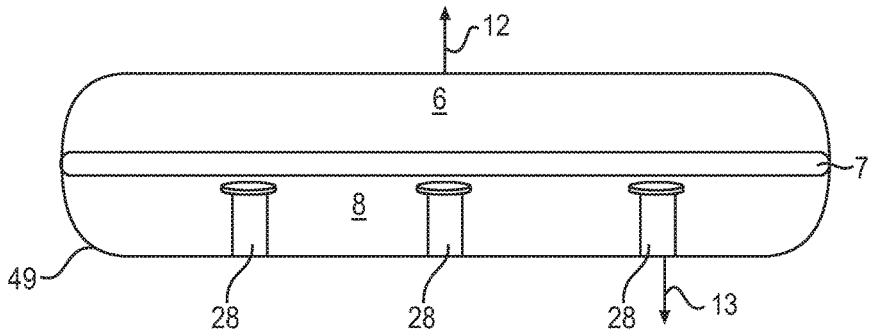
FIG. 5 shows a much simplified schematic of a crude petroleum desalter unit utilizing the option of injection from the water using radial distributors.

FIG. 5 shows a vertical cross-section of a desalter vessel in which injection of demulsifier into the rag layer is effected using a radial distributor design. Radial distributors (28) fed with demulsifier from manifold (49) can be used to deliver demulsifier chemical to the rag layer (7) with a minimum vertical component of velocity. The distributors may simply have a flat plate over the vertically oriented outlet conduit or have a domed or downturned cap similar to the "bubble cap" of a distillation column.

Figure 6:
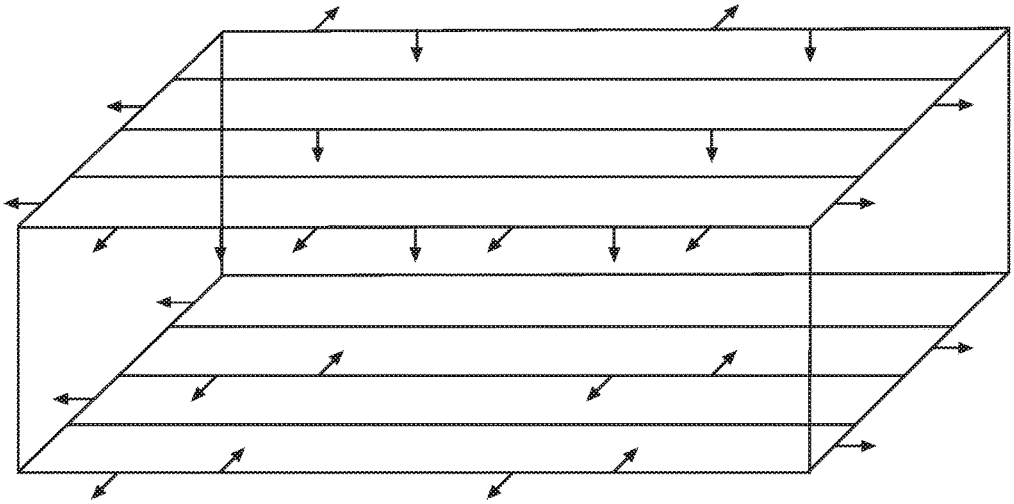
FIG. 6 shows a much simplified schematic of an injection gage for injecting demulsifier at multiple locations and angles.

FIG. 6 is an isometric schematic of an injection system in which demulsifier is injected both above and below the rag layer using a cage distributor. A cage distributor can be positioned with the rag layer "inside the cage, allowing for delivery of the demulsifier chemical from both above and below the rag layer. The cage injection system itself may have multiple lines extending above and below the emulsion layer and these may inject demulsifier into various angles at or into the emulsion layer. Using a cage-type injector, the demulsifier can be directed upwards, downwards as well as in any angular direction in or around the cage.

What is claimed is:

1. A petroleum desalting process which comprises:

mixing a crude oil with water to form a mixture of oil and water, exposing the mixture of oil and water in the form of an emulsified oil/water mixture to an electric field to cause separation of the mixture into a separated denser water layer containing dissolved salts and a supernatant oil layer with the formation of a stabilized emulsion layer between the oil layer and the separated water layer, wherein the stabilized emulsion layer is formed from the oil, the water and emulsion-stabilizing solids, adding a demulsifier to the separated mixture to form a higher localized concentration of demulsifier in the stabilized emulsion layer to destabilize the emulsion, wherein adding the demulsifier to the separated mixture includes adding the demulsifier to the oil layer above the stabilized emulsion layer and the separated water layer below the stabilized emulsion layer, and removing the separated oil and water layers.

2. A petroleum desalting process according to claim 1 in which demulsifier is also added to the crude at the upstream of a desalter.

3. The method according to claim 1, wherein adding the demulsifier to the separated mixture includes adding the demulsifier to the separated mixture in the oil layer above the stabilized emulsion layer and the separated water layer below the stabilized emulsion layer using an injection system having a cage distributor whereby the stabilized emulsion layer is located within the cage distributor.

* * * * *